United States Patent [19]

Kern

[11] Patent Number: 4,812,624

[45] Date of Patent: Mar. 14, 1989

[54] TEMPERATURE SENSOR ASSEMBLY FOR AN AUTOMATIC SURFACE UNIT

[75] Inventor: Jeffrey A. Kern, Louisville, Ky.

[73] Assignee: General Electric Company, Louisville, Ky.

[21] Appl. No.: 138,583

[22] Filed: Dec. 28, 1987

[51] Int. Cl.[4] ..... H05B 3/70

[52] U.S. Cl. ..... 219/450; 219/516

[58] Field of Search ..... 219/450, 451, 448, 449, 219/516, 518

[56] References Cited

U.S. PATENT DOCUMENTS

| | | | |
|---|---|---|---|
| 2,399,423 | 4/1946 | Bletz | 219/449 |
| 2,764,661 | 9/1956 | Molyneaux | 219/450 |
| 2,781,038 | 2/1957 | Sherman | 219/516 |
| 2,806,122 | 9/1957 | Thunander | 219/450 |
| 3,868,620 | 2/1975 | McBride, Jr. et al. | 338/28 |
| 4,146,865 | 3/1979 | Scharbach et al. | 338/28 |
| 4,330,701 | 5/1982 | Fischer et al. | 219/450 |
| 4,351,996 | 9/1982 | Kondo et al. | 219/10.49 R |
| 4,399,351 | 8/1983 | Koff | 219/449 |
| 4,410,793 | 10/1983 | Fischer et al. | 219/450 |
| 4,527,005 | 7/1985 | McKelvey et al. | 136/221 |
| 4,549,162 | 10/1985 | Grimm | 338/28 |
| 4,710,611 | 12/1987 | Axelson | 219/450 |

*Primary Examiner*—Teresa J. Walberg

*Attorney, Agent, or Firm*—H. Neil Houser; Radford M. Reams

[57] ABSTRACT

A temperature sensor assembly for an automatic solid disk surface unit includes a temperature sensor enclosed in a metallic hermetically sealed generally cylindrical housing. Upper and lower centrally apertured annular disks formed of a porcelain ceramic material thermally isolate the sensor housing from the surrounding surface unit. A protective metallic skirt conforming to the outer contour of the insulating disks holds the assembly together. A layer of glaze material covers the exposed upper surface of the upper disk in the gap between the skirt and the housing to prevent the absorption of food soils.

15 Claims, 2 Drawing Sheets

TEMPERATURE SENSOR ASSEMBLY FOR AN AUTOMATIC SURFACE UNIT

BACKGROUND OF THE INVENTION

This invention relates to an improved temperature sensor for use with a solid disk automatic surface unit for an electric range or cooktop.

The use of automatic temperature controls for electric range surface units is well known. Generally, a utensil temperature sensor is mounted in the center of the surface unit to physically contact the bottom of the cooking utensil being heated. The utensil temperature is sensed by a sensing element such as a thermistor or thermocouple and the resulting signal is used by the automatic temperature control circuitry to maintain a desired cooking temperature as set by the user. An example of such control circuitry is illustrated in U.S. Pat. No. 4,493,980 which describes operating modes for boiling and frying. In the boiling mode, the temperature information may be used to provide rapid heat up, detect the boil point and maintain selected approximate boil rate. Examples of boil point detection arrangements may be found in U.S. Pat. Nos. 4,465,228 and 4,665,292.

The ability of the sensor to accurately sense and follow temperature variations in the cooking utensil is critical to maintaining the desired cooking temperature. When operating in a boil mode in which power is reduced upon detection of reaching the boil point, accuracy during the heat up phase is particularly critical as the premature detection of boil point may result in an unnecessarily prolonged heat up period. One factor adversely affecting accuracy is the exposure of the sensor to heat from the surface unit in addition to heat from the utensil. In commonly used sheathed surface heating units the sensor is spaced somewhat from the surrounding heating unit. Thus, the primary heat transfer mechanism is radiation from the sheathed element rather than conduction. One approach found to be effective in protecting against such radiation is disclosed in U.S. Pat. No. 4,241,289.

However, solid disk surface units are finding increasing popularity in this country. One particular advantage is that the solid disk unit provides a closed surface, lending itself to easier cleanability. In order to provide a solid disk automatic surface unit which retains the closed surface advantage, the sensor assembly must substantially fill the central opening provided in the solid disk to accommodate the sensor. An example of one such surface unit equipped with an electromechanical sensor and control arrangement is disclosed in U.S. Pat. No. 4,330,701. The sensor i this arrangement uses fluid expansion in a capillary tube to sense utensil temperature. The sensor head is a sheet metal dish which extends across the central opening in the surface unit. Since the sensor is not spaced from the surface unit as it is in sheathed heating units a potential problem with such an arrangement results from the sensor head being additionally heated directly by the surrounding surface unit. In typical fry mode operations in which the user selects a desired steady state temperature for the utensil, the temperature variations need not be accurately followed in order to satisfactorily maintain the selected nominal temperature. Thus, the affect of this heat from the surface unit is tolerable. However, for applications in which following variations in temperature accurately is more critical, such as with control systems which provide the above-described boil mode in which the surface unit is driven at full power prior to boil point detection to provide faster response, and relatively low power thereafter, heating of the sensor directly by the surface unit can seriously impair performance.

Therefore, a need exists for and it is a primary object of this invention to provide a sensor assembly for use in a solid disk surface unit, which retains the cleanability advantages associated with a closed surface while preventing the detrimental effects of direct heating of the sensor by the surrounding surface unit.

SUMMARY OF THE INVENTION

An improved temperature sensor assembly is provided for mounting in the central opening of an automatic solid disk surface unit in a cooking appliance. The assembly includes a sensor enclosed in an elongated metallic housing for sensing the temperature of a utensil being heated on the surface unit. The housing comprises a hermetically sealed chamber with a flat upper wall for contacting the bottom of the utensil being heated. A centrally apertured insulating member receives the housing in the aperture to thermally isolate the housing. The upper wall of the housing is raised relative to the upper surface of the insulating member for contact with the utensil. A protective metallic skirt extends about the periphery of the insulating member with the uppermost edge of the skirt being radially spaced from the housing defining a gap therebetween.

In a preferred form of the invention the sensor is enclosed in a metallic hermetically sealed generally cylindrical housing with a flat upper wall and an outwardly extending peripheral flange at the base of the housing. A cylindrical metallic stem portion extends downwardly from the base to protectively enclose electrical leads from the sensor. The insulating member comprises upper and lower centrally apertured annular disks formed of a porcelain ceramic material. The housing projects upwardly through the aperture in the upper insulating disk for contact with the utensil being heated. The stem projects downwardly through the aperture in the lower insulating disk, with the peripheral flange being sandwiched between insulating disks to retain and position the housing. A metallic skirt conforming to the outer contour of the insulating disks holds the assembly together. The upper edge of the skirt extends radially inwardly over a portion of the upper insulating member toward the housing but is spaced therefrom defining a gap. A layer of glaze material covers the exposed upper surface of the upper disk in the gap to prevent the absorption of food soils.

BRIEF DESCRIPTION OF THE DRAWINGS

While the novel features of the invention are set forth with particularity in the appended claims, the invention, both as to organization and contents, will be better understood and appreciated along with other objects and features thereof, from the following description in conjunction with the drawings, in which:

DETAILED DESCRIPTION

Figure 1:
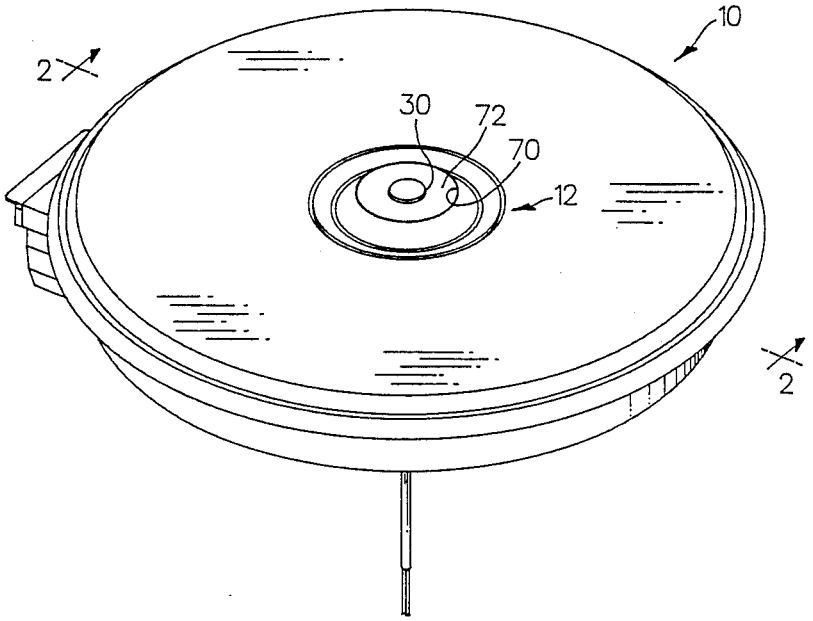
FIG. 1 is a perspective view of a solid disk surface unit incorporating sensor assembly of the present invention.

FIG. 1 shows a perspective view of a conventional solid disk surface unit 10 made from cast material with sensor assembly designated generally 12 mounted in the central opening thereof. Surface unit 10 is typically mounted in an electric cooktop or range for heating utensils placed thereon. Temperature sensor 12 senses the temperature of the bottom of the utensil to control power to the surface unit.

Figure 2:
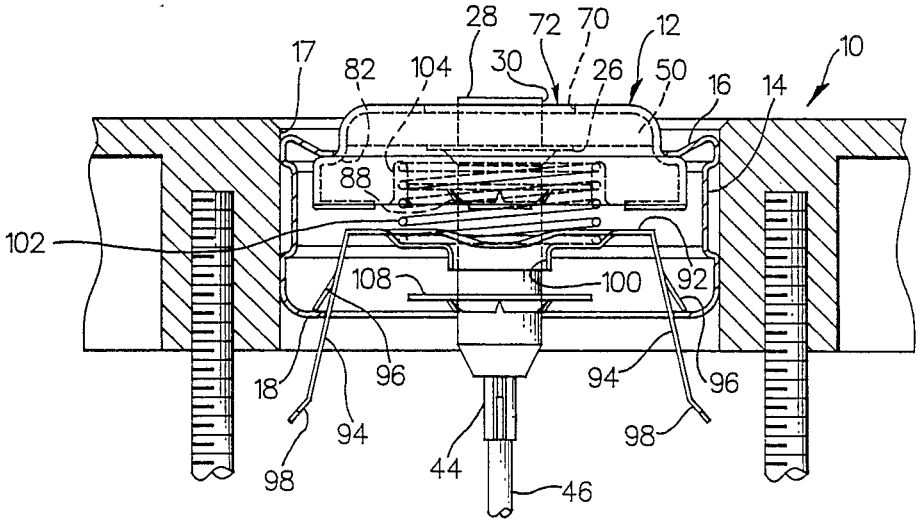
FIG. 2 is a partial sectional view of the surface unit of FIG. 1 taken lines 2—2.
Figure 3A:
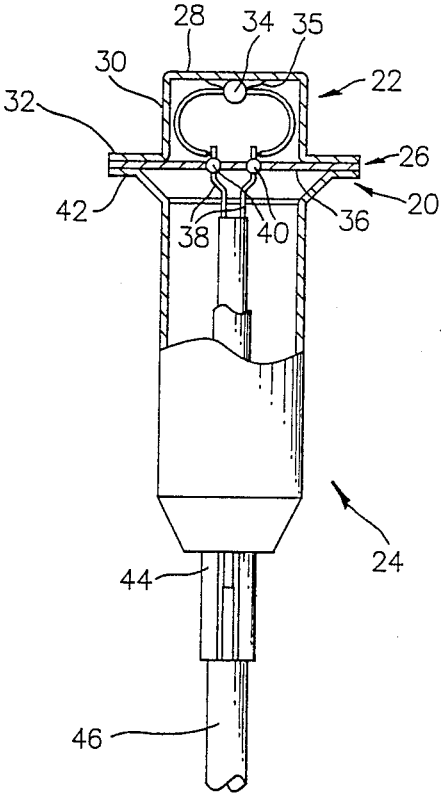
FIG. 3A is a plan view with portions removed of the sensor housing in the sensor assembly of FIG. 1.
Figure 3B:
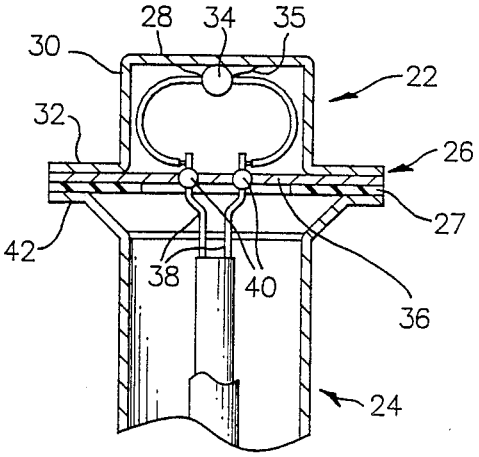
FIG. 3B is a plan view with portions removed of an alternative sensor housing structure for use in the sensor assembly of FIG. 1.
Figure 4:
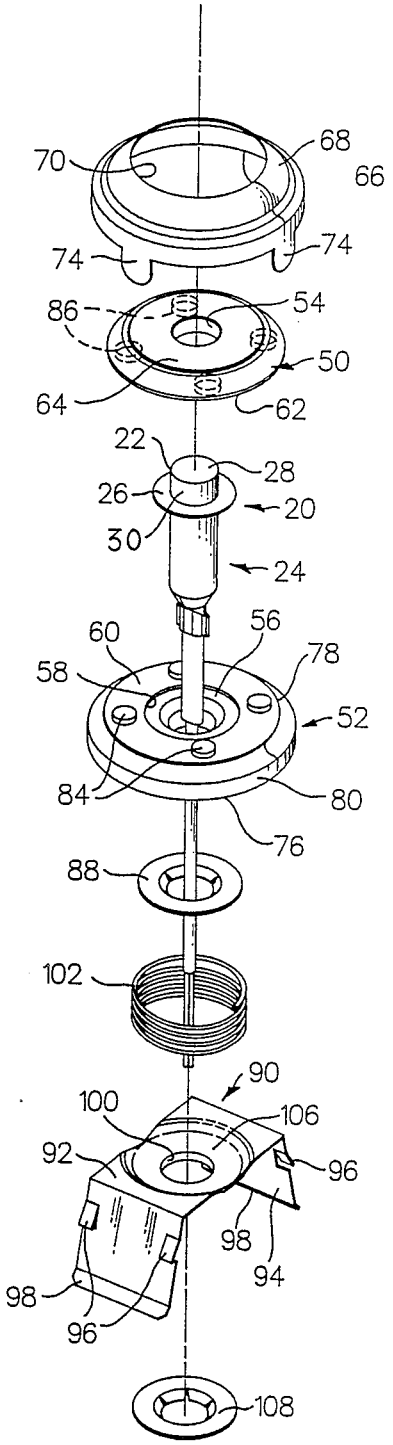
FIG. 4 is an exploded perspective view of the sensor assembly and mounting structure of FIG. 1.

Referring now primarily to FIGS. 2–4, the central opening in surface unit 10 is lined with a metallic, preferably stainless steel, collar 14 which is suitably secured such as by press fitting in the central opening 17 of the surface unit. Collar 14 has inwardly turned upper and lower lips 16 and 18 respectively for retaining the sensor assembly and mounting structure in opening 17.

Sensor assembly 12 comprises an elongated generally cylindrical housing 20 which encloses the temperature sensor. Housing 20 includes an upper hermetically sealed chamber portion 22 for enclosing the sensor and a downwardly extending stem portion 24 which houses the electrical leads connecting the sensor to the power control system. An outwardly extending peripheral retaining flange 26 is formed at the intersection of the chamber and the stem portion which serves to retain the housing in the sensor assembly as will be hereinafter described.

The chamber portion 22 of housing 20 includes a top wall 28 and a cylindrical side wall 30 with a peripheral flange 32 formed at the lower edge of side wall 30. When fully assembled and positioned in the surface unit, top wall 28 of housing 20 will contact the bottom surface of the utensil being heated. The temperature sensor is a thermistor 34 (FIG. 3) mounted in close thermal contact with the inner surface of top wall 28. The sensor is suitably secured to the top wall such as by an appropriate adhesive 35.

The base member of chamber 22 is a generally flat circular metallic disk 36. Two small openings are provided in the disk to accommodate the electrical wires 38 from the sensor which project from the chamber for connection to the sensor circuitry (not shown). Each opening receives a glass electrical insulation bead 40 apertured to receive a wire. Base member 26 is suitably secured to the flange 32 of side wall 30, such as by welding, to form the hermetic seal.

Cylindrical stem portion 24 of housing 20 extends downwardly from the base of chamber 22. An annular flange 42 formed at the upper edge of stem 24 is suitably secured to the lower surface of base member 26 such as by welding. The lower end 44 of stem 24 is crimped to provide a tight fit to the glass wool sheath 46 which encloses the electrical wires 38.

The resultant annular retaining flange 26 at the juncture of chamber 22 and stem 24, comprising flange 32, disk 36 and flange 42, serves to axially retain housing 20 in the sensor assembly as will be hereinafter described.

It will be recalled from the background discussion that an objective of the present invention is to thermally isolate the sensor from the surrounding surface unit. To this end, thermally isolating centrally apertured insulation means is provided in the form of centrally apertured upper and lower insulating disks 50 and 52 respectively, formed of porcelain ceramic material or other suitable material capable of withstanding temperatures on the order of 750° F. The chamber portion 22 of housing 20 projects through central aperture 54 in upper insulating disk 50 for contact with the utensil. The stem portion 24 of housing 20 projects downwardly through central aperture 56 in lower insulating disk 52. A recess 58 on the upper surface 60 of lower disk 52 circumscribing central aperture 56 receives retaining flange 26. When fully assembled, upper surface 60 of lower disk 52 abuttingly engages the bottom surface 62 of upper disk 50 sandwiching flange 26 therebetween. Flange 26 is sufficiently vertically spaced from top wall 28 of chamber 22 to enable chamber to project above upper surface 64 of disk 50 sufficiently for good thermal contact with the utensil.

A metallic outer skirt 66 conforms to the peripheral contour of the upper and lower porcelain disks to hold the disks together and to protect the edge of the porcelain from utensil impact damage. The upper inwardly turned portion 68 of skirt 66 extends radially inwardly overlapping the outer portion of upper surface 64 of upper porcelain member 50. The upper edge 70 of skirt 66 is radially spaced from side wall 30 of housing 20 defining a gap 72 therebetween. Upper surface 64 of upper disk 50 is slightly raised in this region to provide a surface essentially flush with the outer surface of skirt 66. The exposed porcelain surface in gap 72 is covered with a thin layer of glaze material to seal the porcelain against the absorption of food stains and cooking odors.

Four tabs 74 of equally spaced intervals formed (2 not shown) at the lower edge of skirt 66 are bent inwardly against the lower surface 76 of bottom porcelain disk 52. The inwardly extending upper portion 68 of skirt 66 and the bottom tabs 74 cooperate to hold upper and lower disks 50 and 52 together.

The upper disk 50 and the reduced diameter upper portion 78 of lower disk 52 are of a diameter slightly less than the diameter of the central opening defined by the upper lip 16 of collar 14. The outer diameter of the lower portion 80 of lower disk 52 is slightly greater than the central opening at upper lip 16. The resultant peripheral shoulder 82 acts as a stop and seal against the upper collar lip 16.

Four raised knobs 84 are provided on the upper surface 60 of lower disk 52. Corresponding circular depressions 86 are formed in the lower surface 62 of upper disk member 50. Knobs 84 project into depressions 86 thereby preventing relative rotational movement between upper and lower disks 50 and 52.

Rotational movement of housing 20 relative to disks 50 and 52 is prevented by a retaining means in the form of a push nut 88 which tightly engages the side wall of stem portion 24. Push nut 88 is snugged up against the lower surface 76 of bottom porcelain disk 52 tightly securing lower disk 52 between push nut 88 and housing flange 26.

If desired, additional thermal isolation of the temperature sensing thermistor may be achieved by inserting thermal insulating means between the hermetically sealed chamber 22 and stem 24. This could be achieved by simply creating an air gap between chamber 22 and stem 24, or as illustrated in FIG. 3B, by inserting a thermal insulating member in the form of a ceramic washer 27 between base member 36 and flange 42 of stem 24, to provide a thermal barrier between chamber and stem. For the configuration of FIG. 3B chamber 22, washer 27 and stem 24 could be simply held together by upper and lower porcelain disks 50 and 52 (FIG. 4).

In the illustrative embodiment the sensor assembly 12 is supported in opening 17 in surface unit 10 by a greatly simplified novel mounting structure which is the subject of commonly assigned co-pending U.S. patent application Ser. No. 138,606 filed Dec. 28, 1987 in the name of the same inventor, the descriptive portion of which is hereby incorporated by reference.

The central element of the support structure is support bracket 90. Bracket 90 is of generally inverted U-shape with a generally horizontal central portion 92 and downwardly extending legs 94. Bracket 90 is integrally formed from sheet metal stock such as by stamping and lanced and bent to the desired configuration. Each of legs 94 includes a pair of outwardly projecting tangs 96, for abuttingly engaging the lower lip 18 of collar 14 to prevent downward movement of support bracket 90. Legs 94 are self-biased outwardly to bear against lower lip 18 of collar 14. Portions 98 of the legs extending beneath the tangs project below the collar when fully assembled. This extended portion of the legs 94 may be easily manually or mechanically grasped and flexed thereby facilitating insertion and removal of the bracket from the collar.

Central portion 92 of bracket 94 has formed therein an aperture 100 for slidably receiving the stem portion 24 of the sensor assembly 12. Stem 24 also projects through a helical coil spring member 102 which is interposed between bracket 90 and the sensor assembly to vertically bias the sensor assembly against the utensil. The spring force of spring member 102 is selected to provide sufficient force to insure good contact with the utensil bottom for sensing, while limiting the force sufficiently to prevent lifting of lightweight utensil loads from the surface unit surface.

The diameter of spring 102 is sufficiently large to aid in maintaining a horizontal positioning of the sensor head while allowing sufficient tipping to enable the upper wall 28 of sensor housing 20 to align with warped utensil surfaces.

A groove 104 is formed in the lower surface 76 of bottom porcelain disk 52 to receive the upper end of spring 102. An annular recess 106 in central portion 92 of bracket 90 receives the lower end of spring 102. Groove 104 and recess 106 serve to maintain spring 102 in position centered about stem portion 24. It is important to retain the spring in this centered position. Should the spring move off center, the spring force could bias the sensor head in a cocked or tilted position resulting in poor contacts with the utensil. In addition, the combined depth of groove 104 and recess 106 are sufficient to fully contain the spring 102 when fully compressed. This permits the central portion 92 of bracket 90 to act as the lower stop for the sensor assembly when fully assembled, greatly simplifying the mounting bracket structure.

As hereinbefore described, legs 94 are self-biased outwardly. In addition, the shape of the support bracket 90 with legs 94 slightly outwardly flared also converts some of the downward force of spring 102 against the central portion 92 of support bracket 90 to an outward force further aiding in pressing tangs 96 into engagement with the lower collar lip 18.

To facilitate assembly of the combined sensor assembly and support structure a second push nut 108 is secured to stem 24 beneath bracket 90. Push nut 108 retains the sensor assembly and support structure in assembly when the sensor is not installed in the surface unit.

While in accordance with the Patent Statutes, a specific embodiment of the present invention has been illustrated and described herein, it is realized that numerous modifications and changes will occur to those skilled in the art. For example, the sensor assembly could be readily adapted for use in combination with a mounting structure different from that herein described. It is therefore to be understood that the appended claims are to be intended to cover all such modifications and changes as fall within the true spirit and scope of the invention.

What is claimed is:

1. A temperature sensor assembly for mounting in a central aperture of an automatic solid disk surface unit in a cooking appliance, said assembly comprising:

a temperature sensor for sensing temperature of a bottom surface of a utensil being heated on the surface unit;

a metallic hermetically sealed generally cylindrical housing for enclosing said sensor, said housing having base and a flat upper surface for contact with the bottom of the utensil and an outwardly extending peripheral flange at the base of said housing;

a cylindrical metallic stem extending downwardly from said base;

upper and lower centrally apertured insulating members to thermally isolate said housing from the surrounding surface unit, said housing projecting upwardly through the aperture in said upper insulating member for contact with the utensil being heated and said stem projecting downwardly through the aperture in said lower insulating member, said peripheral flange being sandwiched between said upper and lower insulating members to retain said housing;

a metallic skirt conforming to and outer contour of said upper and lower insulating members, said skirt having an upper edge which extends inwardly over a portion of said upper insulating member toward said housing but spaced therefrom defining a gap therebetween.

2. The sensor assembly of claim 1 wherein said insulating members are annular disks formed of a porcelain ceramic material.

3. The sensor assembly of claim 2, wherein said annular disks are of sufficient diameter to substantially fill the central aperture in the surface unit and the diameter of said upper flat surface of said housing is of significantly smaller diameter than said disks.

4. The sensor assembly of claim 3 further comprising a layer of glaze material covering an exposed upper surface of said upper member in said gap between said skirt and said housing to prevent the absorption of food soils by said upper member.

5. The sensor assembly of claim 1 further comprising insulating means positioned between said housing and said stem to thermally isolate said chamber from said stem portion.

6. The sensor assembly of claim 5 wherein said insulating means comprises an insulating washer formed of porcelain sandwiched between the outer face of said base of said housing and said stem.

7. A temperature sensor assembly for mounting in a central aperture of an automatic solid disk surface unit in a cooking appliance, said assembly comprising:

a temperature sensor for sensing temperature of a bottom surface of a utensil being heated on a surface unit;

an elongated metallic housing comprising an upper hermetically sealed chamber for enclosing said sensor and a stem portion extending downwardly therefrom, said sensor being mounted in said chamber closely adjacent an upper end wall thereof, said housing further comprising a peripheral retaining flange extending outwardly from said housing and vertically spaced from said upper wall of said chamber;

upper and lower centrally apertured thermal insulating disks for retaining said housing and thermally insolating said housing from the surface unit, said housing extending through the central apertures of said upper and lower disks, said retaining flange being sandwiched therebetween to retain said housing in said central apertures, an upper end of said housing projecting from an upper surface of said upper disk for contact with the bottom surface of the utensil being heated;

retaining means secured to said stem portion of said housing beneath said lower disk to retain said lower disk between said retaining means and said retaining flange; and a metallic skirt confining said upper and lower disks, an upper edge of said skirt being spaced from said housing defining a gap therebetween.

8. The sensor assembly of claim 7 wherein said insulating disks are formed of a porcelain ceramic material.

9. The sensor assembly of claim 7 further comprising a layer of glaze material covering the exposed upper surface of said upper disk in said gap between said skirt and said housing, to prevent absorption of food soils by said upper disk.

10. A temperature sensor assembly for mounting in a central opening an automatic solid disk surface unit of the type in which the opening is lined with a metallic collar having inwardly turned upper and lower lips for retaining a sensor therein, said assembly comprising:

a temperature sensor for sensing temperature of a bottom surface of a utensil being heated on the surface unit;

a metallic generally cylindrical elongated housing for enclosing said sensor, said housing comprising a cylindrical side wall and a top wall, said sensor being disposed closely adjacent an inner surface of said top wall;

said housing further comprising an annular retaining flange extending radially outwardly from said cylindrical side wall and axially spaced from said top wall;

upper and lower centrally apertured insulating disks for retaining said housing and thermally isolating said housing from the solid disk surface unit, said housing extending through said central apertures of said upper and lower disks with said retaining flange being sandwiched therebetween, said housing extending above an upper surface of said upper disk for contact between said top wall and the bottom surface of the utensil being heated;

an annular retaining ring secured to an outer cylindrical side wall of said housing beneath said lower disk to secure said lower disk between said retaining ring and said retaining flange; and a metallic skirt conforming to a peripheral contour of said upper and lower disks, an upper edge of said skirt extending radially inwardly over a portion of the upper surface of said upper disk to protect and confine said upper disk, said upper skirt edge being radially spaced from said cylindrical side wall of said housing defining a gap therebetween.

11. The sensor assembly of claim 10 wherein an outer diameter of said upper disk is slightly less than a diameter of the surface unit opening defined by the upper collar lip, and an outer diameter of said lower disk is slightly greater than said opening thereby defining a circumferential retaining shoulder at a periphery of said assembly for retaining engagement with the upper lip.

12. The sensor assembly of claim 11 wherein said upper and lower disks are formed of a porcelain ceramic material.

13. The sensor assembly of claim 12 wherein the exposed portion of the upper surface of said upper disk in said gap is glazed to prevent the absorption of food stains and odors.

14. The sensor assembly of claim 13 further comprising means for preventing relative rotational movement of said upper disk relative to said lower disk.

15. The sensor assembly of claim 14 wherein said means for preventing rotation comprises one or more knobs on the surface of one of said upper and lower disks adjacent said other disk and complementary depression in the other of said disks on said adjoining surface, each of said knobs being received in one of said complementary depression to prevent relative rotational movement of said upper and lower disks.

* * * * *